US005795625A

United States Patent [19]

Spiegel et al.

[11] Patent Number: 5,795,625

[45] Date of Patent: Aug. 18, 1998

[54] COATING SOLUTION DISTRIBUTION APPARATUS

[75] Inventors: James Michael Spiegel, Spencerport; Trevor Dean Huls, Honeoye; James Michael Peck, Rochester, all of N.Y.

[73] Assignee: Eastman Kodak Company, Rochester, N.Y.

[21] Appl. No.: 683,006

[22] Filed: Jul. 16, 1996

[51] Int. Cl.[6] ..... B05D 1/18

[52] U.S. Cl. ..... 427/434.5; 427/434.2; 118/410; 118/423; 118/429

[58] Field of Search ..... 427/434.2, 434.5; 118/429, 410, 423

[56] References Cited

U.S. PATENT DOCUMENTS

| | | | |
|---|---|---|---|
| 2,168,997 | 8/1939 | Lankes et al. | 91/10 |
| 2,681,294 | 6/1954 | Beguin | 117/34 |
| 3,181,967 | 5/1965 | Amos et al. | 117/67 |
| 3,431,889 | 3/1969 | Fraatz | 118/315 |
| 3,600,750 | 8/1971 | Stroszynski | 18/12 DS |
| 3,665,890 | 5/1972 | Mishler | 118/412 |
| 3,811,924 | 5/1974 | Gallagher et al. | 117/76 |
| 3,863,600 | 2/1975 | VanRegenmortel | 118/419 |
| 3,901,188 | 8/1975 | Eberlein | 118/429 |
| 4,050,410 | 9/1977 | Stroszynski | 118/410 |
| 4,623,501 | 11/1986 | Ishizaki | 118/410 |
| 4,643,127 | 2/1987 | Wanke | 118/410 |
| 4,724,856 | 2/1988 | Pender | 134/122 R |
| 4,909,181 | 3/1990 | Smith | 118/679 |
| 5,007,445 | 4/1991 | Pender | 134/122 R |
| 5,203,922 | 4/1993 | Shibata et al. | 118/410 |
| 5,226,964 | 7/1993 | Meuche | 118/424 |
| 5,386,939 | 2/1995 | Ruegg | 239/7 |
| 5,456,944 | 10/1995 | Trest et al. | 427/128 |

*Primary Examiner*—Katherine A. Bareford
*Attorney, Agent, or Firm*—Mark G. Bocchetti

[57] ABSTRACT

A coating method and apparatus for applying a liquid coating solution containing suspended particulates to a moving web which eliminates areas of stagnation in the reservoir pan thereby resulting in a relatively even application of the particulates to the web. The web is continuously passed through the reservoir pan while supported on a rotatable backing drum. The liquid coating solution is delivered to the coating pan through a distribution conduit a distribution conduit disposed within the reservoir pan generally parallel to the discharge weir of the reservoir pan. The distribution conduit includes a plurality of spaced apart orifices therein to deliver the liquid coating composition in a pair of end streams and a plurality of intermediate streams traveling toward the discharge weir. The distribution conduit is fed from both ends thereof resulting in the end streams flowing at a greater velocity than the intermediate streams.

9 Claims, 4 Drawing Sheets

COATING SOLUTION DISTRIBUTION APPARATUS

BACKGROUND OF THE INVENTION

1. Field of the Invention

The present invention relates generally to coating pan apparatus for application of coatings to webs and, more particularly, to the distribution of coating solutions to and flow of coating solutions through such apparatus.

2. Brief Description of the Prior Art

A variety of apparatus are known in the prior art for the application of coating solutions to moving webs. Many of such apparatus employ reservoirs or pans containing the coating solution at a constant level with the web guided into such pan. One such apparatus is taught in U.S. Pat. No. 3,181,967 to Amos et al. Amos et al teaches an apparatus for applying aqueous conditioning agents to synthetic filaments. Using a cylindrical guide, the synthetic filaments are moved into and out of a reservoir containing the aqueous conditioning agents such that the synthetic filaments are brought into brushing contact with the surface of the liquid in the reservoir. Simultaneously, a liquid finish is fed into the guide and discharged from a slot therein to thereby apply the liquid to the opposite side of the synthetic filaments.

U.S. Pat. No. 3,863,600 to VanRegenmortel teaches an adjustable coating pan for coating a moving web traveling about a backing roller to intersect with a coating solution flowing through the coating pan. The coating solution is pumped into channels along one side of the coating pan. When the maximum level in the channels is reached, the coating solution flows into the coating pan over the entire length thereof, under the backing roller and into a collection trough.

U.S. Pat. No. 2,168,997 to Lankes et al teaches a liquid application pan in which a photographic film base is dipped to apply a subbing layer to the base. The film base is guided about a subbing roll disposed in the pan. This subbing material is delivered to the pan by means of a supply pipe located in the bottom of the pan and extending the length thereof. The supply pipe is provided with a longitudinally extending, tapered discharge slot, the narrow end of the slot being at the inlet end. The purpose of the tapered discharge slot is to create a nearly uniform flow across the length of the pan.

Although some prior art devices teach means for reducing the stagnation of liquid within the pan of a coating apparatus, nothing in the prior art teaches a method or apparatus for preventing the accumulation within the pan of particulates suspended in the coating solution. There are various coating solutions which contain, by design, suspended particulates which are intended to be applied evenly to the web with the coating solution. In such cases, it becomes important to maintain a uniform distribution of the particulates throughout the reservoir and to simultaneously prevent the accumulation of particulates in dead areas of the reservoir through such particulates dropping out of suspension.

SUMMARY OF THE INVENTION

It is, therefore, an object of the present invention to provide a method and apparatus for applying a coating solution to a moving web uniformly wherein the coating solution contains suspended particulates.

It is a further object of the present invention to provide a method and apparatus for applying uniformly a coating solution containing suspended particulates wherein the suspended particulates are prevented from accumulating within the reservoir of such apparatus.

Still another object of the present invention is to provide a coating apparatus for the application of coating solutions to moving webs wherein the coating solution is delivered to the coating pan in a plurality of generally parallel streams and wherein the streams proximate to the ends of the coating pan move at a velocity greater than the streams proximate to the center of the coating pan.

A further object of the present invention is to provide an apparatus and method for the generally uniform application of particulates suspended in a coating solution to a photographic film base web resulting in generally uniform levels of haze across the width of the photographic film base web.

Briefly stated, these and numerous other features, objects and advantages of the present invention will become readily apparent upon a reading of the detailed description, claims and the drawings set forth herein. These features, objects and advantages are accomplished by providing a distribution tube which is disposed within the reservoir pan along the length thereof and wherein the distribution tube is supplied with coating solution from both ends thereof. The interior surface of the reservoir pan is curved and the distribution tube directs a plurality of streams along such surface parallel to one another and generally tangent to the curvature of the surface. In such manner, a plurality of generally parallel streams flow across the reservoir pan to the discharge where delivery of a coating solution from the distribution tube is through a plurality of evenly spaced identically sized orifices. Because the coating solution is delivered to both ends of the distribution tube, and because the orifices are equal in size, head losses to those portions of the coating solution flowing through orifices proximate to the ends of the distribution tube will be less than head losses to those portions of the coating solution flowing through intermediate orifices. Therefore, the velocity of the streams of coating solution delivered through the orifices proximate to the ends of the distribution tube will be greater than the velocity of the streams originating from intermediate orifices. The greater velocity of coating solution moving through the reservoir pan toward the ends thereof does not allow the end areas of the reservoir pan to become stagnant. With a typical center feed delivery of coating solution to a coating apparatus, the solution in the reservoir pan near the end dams tends to stagnate. Stagnation of coating solution containing suspended particulates will allow the suspended particulates to settle out. Once the particulates start to settle out within the reservoir pan, the result is a non-uniform application of the coating solution and particulates to the web. With photographic film base webs, non-uniform application of particulates due to stagnation can result in unacceptable levels of haze in the final film product.

DETAILED DESCRIPTION OF THE PREFERRED EMBODIMENTS

Figure 1:
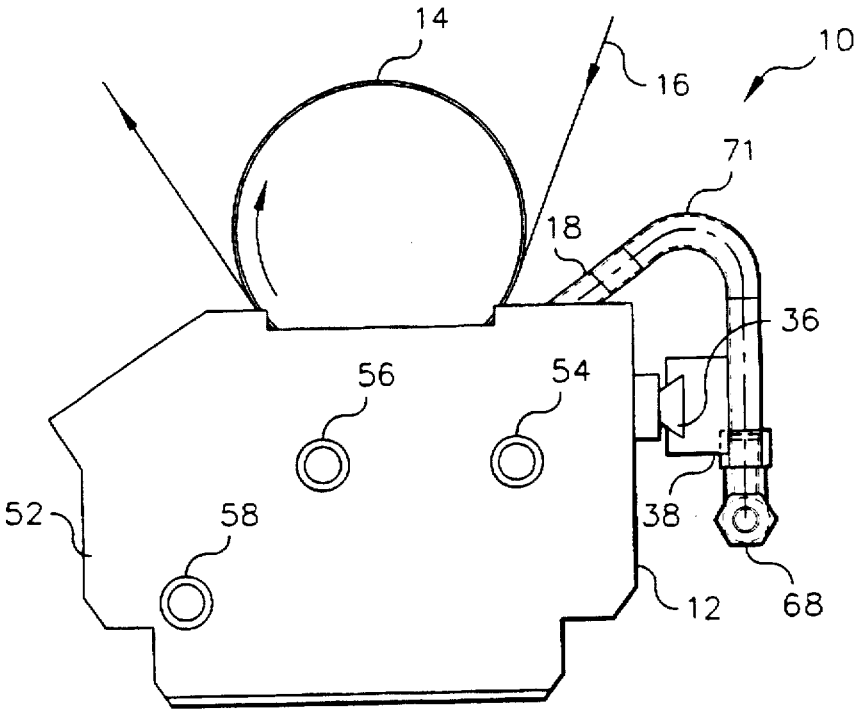
FIG. 1 is a side elevation of the coating apparatus of the present invention.
Figure 2:
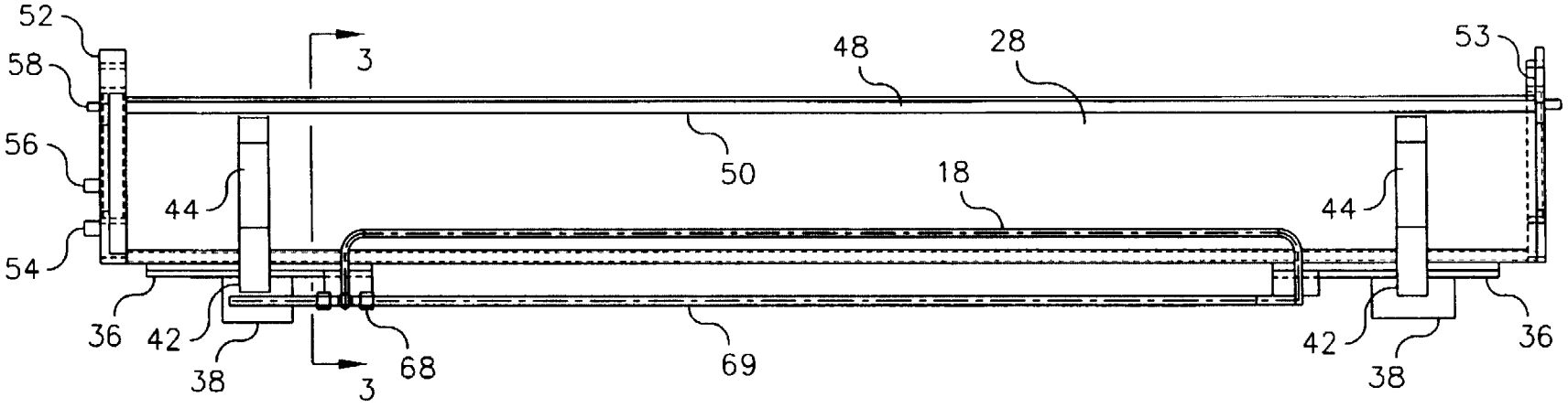
FIG. 2 is a top plan view of the coating apparatus of the present invention with the backing drum removed.

Turning first to FIGS. 1 and 2 there is shown a side elevation and a top plan view, respectively, of the coating apparatus 10 of the present invention. The coating apparatus 10 includes a main housing 12 with a backing drum 14 partially disposed therein. The backing drum 14 is rotatably supported by means not shown such that a web 16 can be guided around backing drum 14 to pass into and out of main housing 12. Coating solution is delivered to the main housing 12 by means of a distribution conduit 18.

Figure 3:
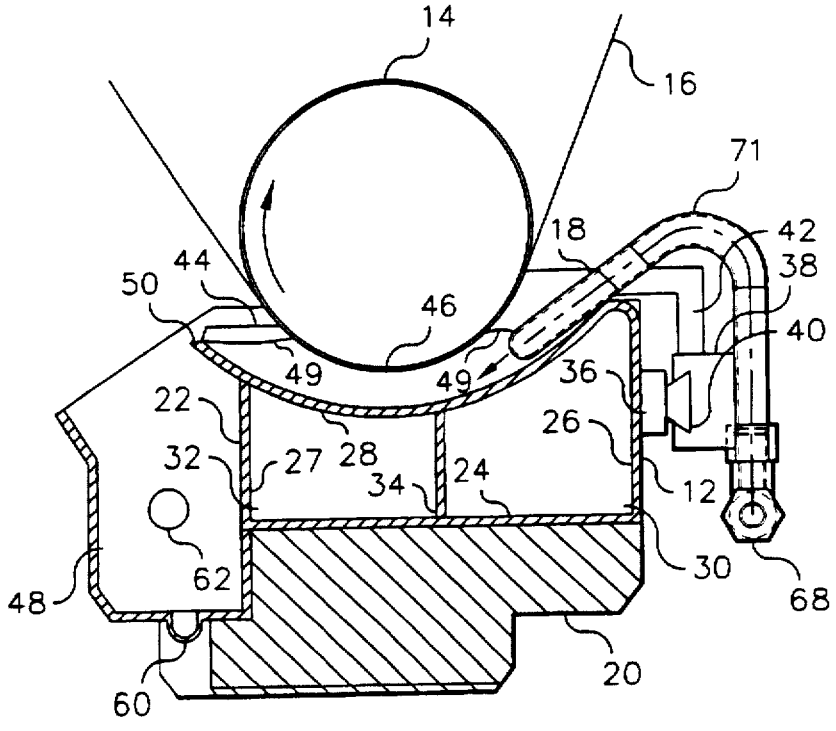
FIG. 3 is a cross-sectional view of the coating apparatus of the present invention taken along line 3—3 of FIG. 2 with the backing drum present.

Looking next at FIG. 3 which depicts a cross-sectional view of the main housing 12 it can be seen that the main housing 12 includes a support member 20 on which is mounted a water jacket 22. Water jacket 22 includes a bottom wall 24, front wall 26, rear wall 27, and top wall 28. Water jacket 22 is divided into a front compartment 30 and a rear compartment 32 by means of baffle 34. Attached to front wall 26 are a dovetail slide bars 36. Slideably engaged with dovetail slide bars 36 are slide box 38 which include dovetail recesses 40 therein. Extending from each slide box 38 is a support arm 42. Integrally formed or fabricated with each support arm 42 is an end dam 44. End dams 44 reside substantially within the reservoir pan formed by top wall 28. The bottom surface of each end dam 44 has a radius of curvature substantially equivalent to the radius of curvature of top wall 28 such that end dams 44 reside in a generally sealed relationship with top wall 28. The radius of curvature of the upper surface 46 of each end dam 44 is about equal to the radius of the backing drum 14. There is a gap between backing drum 14 and upper surface 46 which is generally equal to the thickness of web 16 thereby allowing the web 16 to pass between backing roller 14 and end dams 44. In such manner, the web 16 serves as a seal for coating solution delivered to the reservoir pan so that such coating solution does not flow over end dams 44. Because end dams 44 are mounted, ultimately, to slide box 38, the positioning of end dams 44 can be adjusted to accommodate various widths of web 16 to be coated in apparatus 10 of the present invention. Once the end dams 44 have been placed in a predetermined position for the particular web to be coated, end dams 44 can be locked in that position by means associated with slide box 38. Such means may include threaded tightening devices such as screws or bolts, or knurled knob fasteners, or the like (not shown).

Main housing 12 also includes an overflow chamber 48 into which coating solution flows from the reservoir pan 28. The level 49 of coating solution within the reservoir pan 28 is maintained by means of weir 50 such that coating solution is continuously delivered to reservoir pan 28 by means of distribution conduit 18 with excess coating solution floating over weir 50 and into overflow chamber 48. The overflow chamber 48 and the water jacket 22 are preferably attached to support member 12 by means of welding.

Figure 4:
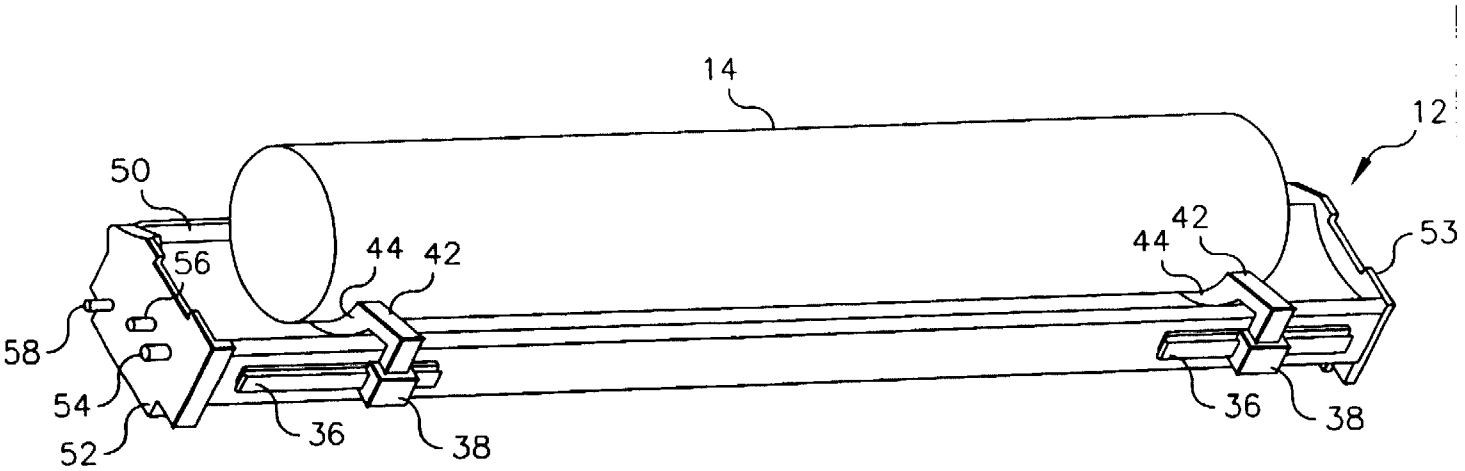
FIG. 4 is a perspective view of the coating apparatus of the present invention with the distribution conduit removed therefrom.

Main housing 12 includes a pair of side walls 52, 53 (see FIG. 4). Side walls 52 has extending therefrom a water inlet fitting 54, a water outlet fitting 56 and a drain fitting 58. Water inlet fitting 54 communicates with front compartment 30 and water outlet chamber 56 communicates with rear compartment 32. Baffle 34 extends to abut end wall 52 and reside in a generally sealed relationship therewith. However, baffle 34 does not extend to abut side wall 53. In such manner, water delivered through water inlet fitting 54 circulates through front chamber 30 around the far end of baffle 34 proximate to side wall 53, into rear compartment 32 to exit through water outlet fitting 56. In such manner, water jacket 22 can be used to maintain the coating solution within reservoir pan 28 at a constant temperature during coating operations.

Drain fitting 58 extending from end wall 52 aligns with sump 60 at the base of overflow chamber 48. There is a water inlet port 62 in end wall 53 which in combination with sump 60 and drain fitting 58 allow overflow chamber to be flushed. Preferably flushing is continuous during operation of the coating apparatus 10 of the present invention.

Figure 5:
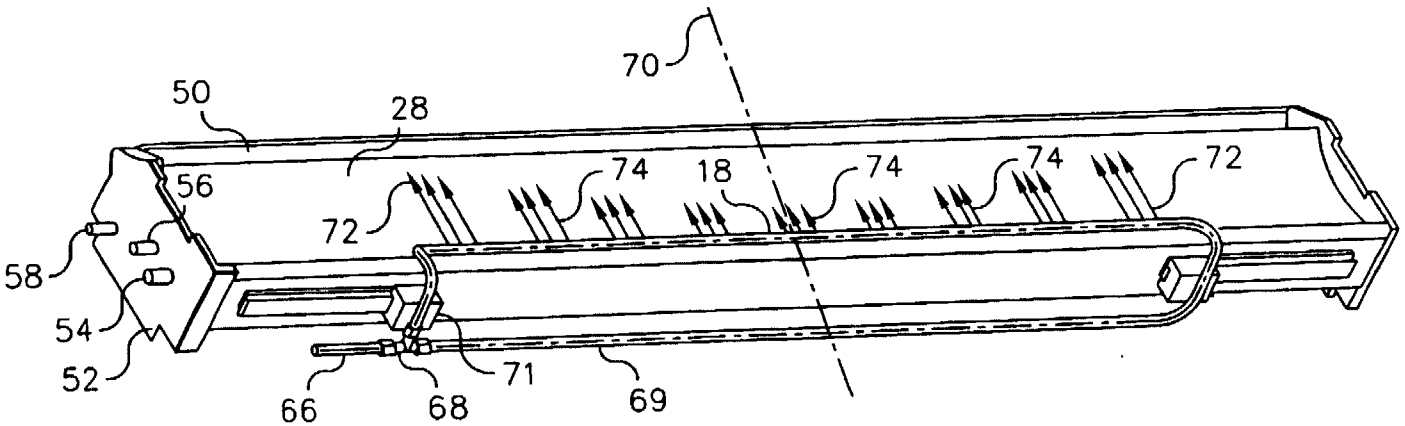
FIG. 5 is a perspective view of the coating apparatus of the present invention with the backing drum and the end dams removed therefrom.

As can be seen in FIGS. 3 and 5, distribution conduit 18 resides, at least partially, within reservoir pan 28. Distribution conduit 18 includes a plurality of spaced apart orifices 64 through which the coating solution is discharged into reservoir pan 28. Each of the plurality of orifices 64 is identical in size and shape. It has been found to be preferable that the sum of the areas of all of orifices 64 be less than one-half the cross-sectional area of distribution conduit 18. The placement of orifices 64 is such that coating solution discharged therefrom is directed generally tangent to the surface of reservoir pan 28. It is preferable that the elevation of distribution conduit 18 be such that orifices 64 reside beneath the level of coating solution within reservoir pan 28. In other words, orifices 64 reside at a lower elevation than weir 50. In this manner, foaming of the coating solution is prevented.

Figure 6:
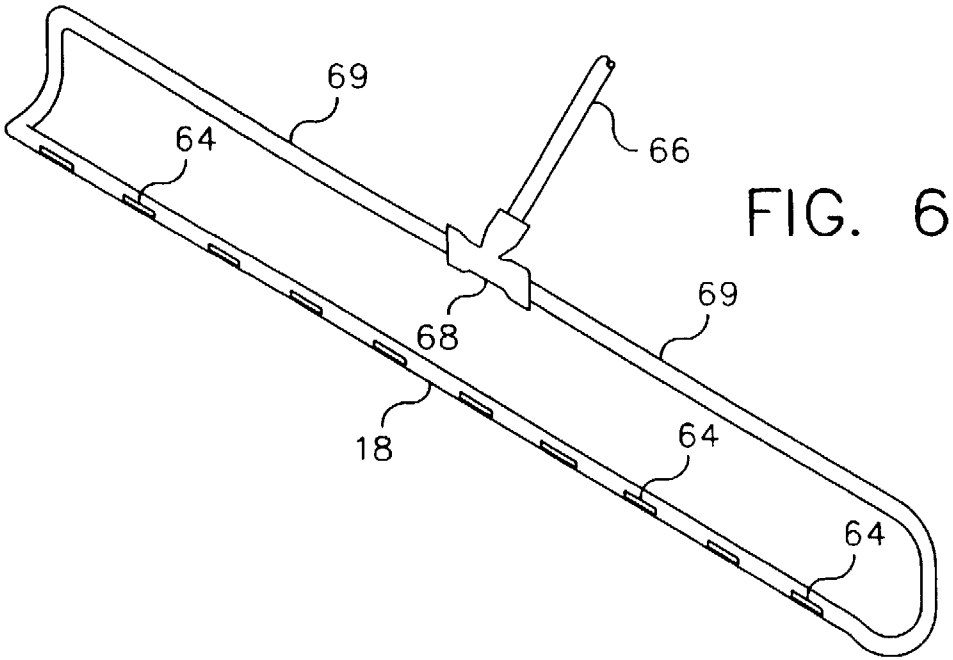
FIG. 6 is a perspective view of the distribution conduit depicted in an inverted position in order to show the location of the orifices.
Figure 7:
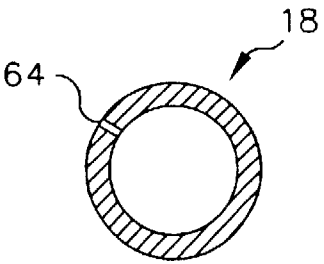
FIG. 7 is a cross-sectional view of the distribution conduit taken along line 7—7 of FIG. 6.
Figure 8:
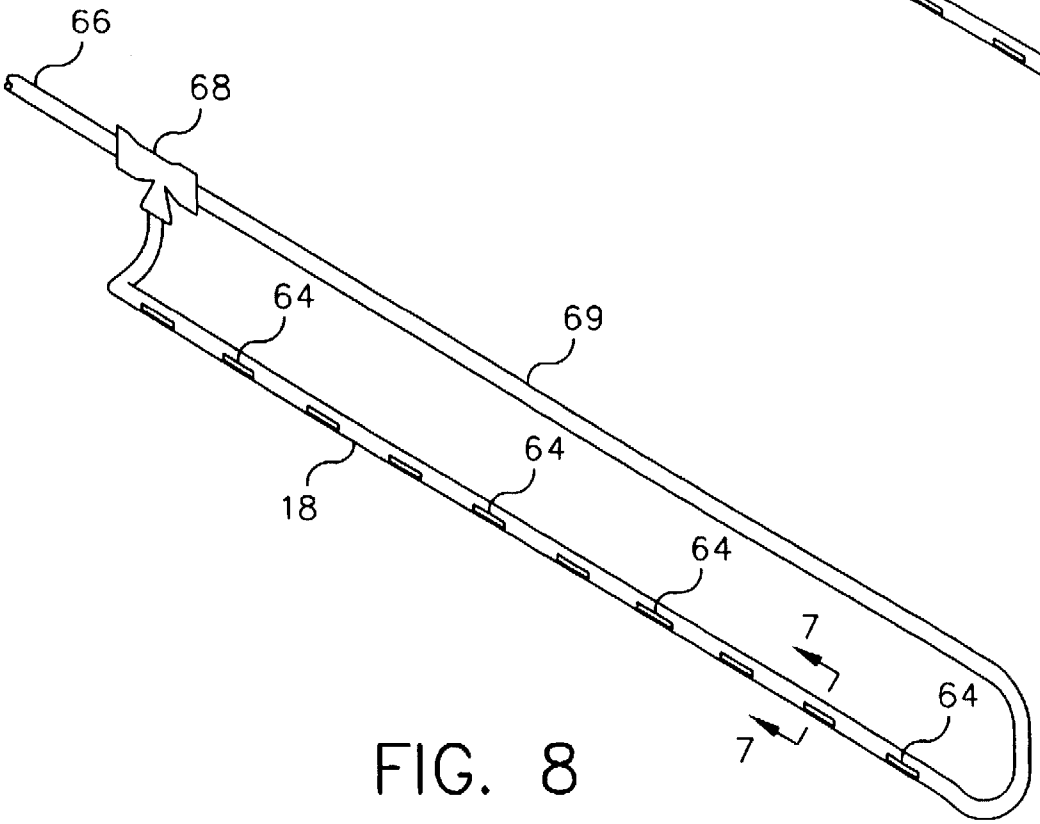
FIG. 8 is an inverted perspective view of the distribution conduit with the tee relocated to the optimum position.

There is a feed conduit 66 through which coating solution is delivered to distribution conduit 18 (see FIGS. 5 and 6). Feed conduit 66 connected to a tee 68 which is, in turn, connected to conduit branches 69, 71 such that coating solution can be delivered simultaneous to both ends of distribution conduit 18. Tee 68, in combination with conduit branches 69, 71 thereby serves as a conduit manifold. Feeding of the distribution conduit 18 at both ends thereof in conjunction with the plurality of orifices 64 of identical size and shape causes the flow of coating solution through orifices 64 to be symmetrical about centerline 70. There is, thus, created a plurality of generally parallel streams of coating solution flowing through reservoir pan 28 from distribution conduit 18 toward weir 50. These parallel streams may be characterized as end streams represented by arrows 72 and intermediate streams represented by arrows 74. Head losses in the flow of coating solution being discharged through orifices 64 located proximate to the ends of distribution conduit 18 will be less than head losses in the flow of coating solution being discharged through orifices 64 intermediate to the ends of distribution conduit 18. Therefore, the volume and velocity of coating solution at the ends of distribution conduit 18 will be greater than the volume and velocity of coating solution flowing from orifices 64 located more toward the middle section of distribution conduit 18. Thus, the volume and velocity of end streams 72 will be greater than the volume and velocity of intermediate streams 74. In fact, the volume and velocity of any intermediate streams 74 will be greater than the volume and velocity of another intermediate stream 74 which is located more proximate to centerline 70. The velocity of each of the streams 72, 74 must be low enough such that all flows are laminar. It will be recognized by those skilled in the art that tee 68 may be moved anywhere along conduit branch 69 and still function adequately. However, the optimum position of tee 69 is shown in FIG. 8.

All of the major components of the apparatus 10 of the present invention are preferably manufactured from stainless steel with the exception of the end dams 44. End dams 44 are preferably made from PVA (polyvinyl alcohol) and as such, end dams 44 become somewhat softened and spongy due to their immersion in the coating solution. This results in better sealing contact between the end dams 44 and reservoir pan 28 and between the end dams 44 and the web 16.

In the operation of conventional coating apparatus, coating solution tends to stagnate in areas proximate to end dams 44. This stagnation becomes a particular problem when the coating solution contains, by design, suspended particulates. When stagnation occurs in this situation the particulates tend to migrate toward the end drains 44 resulting in a higher concentration of suspended particulates in the stagnated areas. This, in turn, results in the application of a higher concentration of particulates to those portions of the web which pass through the stagnated areas. The greater volume and velocity at the ends of distribution conduit 18 eliminates the migration of suspended particulates toward end dams 44 and thereby prevents the suspended particulates from concentrating in the areas close to end dams 44.

The coating apparatus 10 of the present invention has proved particularly useful in the application of coating solutions to polyester photographic film base webs such as Estar®. The apparatus 10 should be useful for the application of coating solutions to other types of webs, particularly where the coating solutions include suspended solids. In the case of polyester film base web, for example, it is often necessary to provide such base web with an initial coating to promote bonding of future coating layers. This initial coating will often contain suspended particulates which will aid in the conveyance of the web in subsequent downstream processes and may also aid in inhibiting the build-up of static charge during such downstream processes. If the suspended particulates have not been uniformly applied to the film base then areas of high static build-up can develop on the film during subsequent downstream processes. In addition, non-uniform application of such particulates can result in downstream conveyance problems such as reliable transport of the web through the downstream process, slippage between the web and conveyance rollers in downstream processes and wound roll integrity. Reliable transport and picking of individual sheets in downstream finishing processes may also be affected.

The initial coatings are also susceptible to physical haze level differences. These differences in haze levels are created by stagnation areas within the reservoir pan. The heavier lay down of suspended particulates in the stagnation area toward the end dams 44 of reservoir pan 28 results in poor visual appearance of the coated web due to high levels of haze at the edges and lower levels of haze nearer the centerline 70. An acceptable haze level of three percent (3%) or less is required for a given photographic film web product across the entire width of the web. In the areas where stagnation occurs, unacceptable levels of haze greater than three percent (3%) are the result. With the coating apparatus of the prior art, haze levels as a result of stagnation would be as high as 8 to 10 percent on the outer eight inches on each side of the web with haze levels at the center of the web being in the range of one to two percent. With the coating apparatus 10 of the present invention, haze levels are consistently in the range of from about 1 to about 2.5 percent across the entire width of the web.

Haze, which is expressed as a percentage, is determined using ASTM Standard D 1003. The test method of such standard covers the evaluation of specific light-transmitting and wide-angle-light-scattering properties of planar sections of materials such as essentially transparent plastic. Haze measurement may be accomplished with a spectrophotometer or with a commercial hazemeter. One such commercial hazemeter is the Hazeguard XL-211 Gauge as manufactured by BYK-Gardner USA of Silver Spring, Maryland.

The present invention has been used successfully to apply base coatings to polyester base film webs wherein the coating solution delivered to the reservoir pan 28 contained, by design, suspended particulates typically referred to as matte. Matte is used herein to mean polymethyl methacrylate codivinylbenzene. The particulates in suspension range in size from 0.1 micron to 50 microns. In operation, volume of coating solution delivered to the reservoir pan through the distribution conduit 18 was at a rate of 1500 cc/minute. Application of coating solution to the web was at the rate of 1000 cc/minute resulting in about 500 cc/minute flowing over weir 50 into overflow chamber 48. The pressure of coating solution within the distribution conduit 18 was about 8 psi. The volume of the reservoir pan 28 was about 3961 cc. The distribution conduit 18 was fabricated from 0.375 inch OD by 0.049 inch wall thickness stainless steel tubing. The distribution conduit measured 40 inches from end to end and included 10 slot orifices each measuring 1 inch in length and 0.008 inches in width.

In operation, the coating apparatus 10 of the present invention achieves a uniform distribution of matte particulates suspended in the coating solution onto the photographic film base web 16. For example, the initial solution for film base webs is generally made up of polyvinyl alcohol, demineralized water and matte. Other constituents may be present in the coating solution depending on the particular film product being made. The quantity of matte present in suspension with the coating solution is in the range of from about 0.02% to about 0.06% by weight of the combined weight of the coating solution and the particulates. The goal in applying matte to the web is to achieve a distribution of particulates in the range of 21–45 matte beads per four square inches. In this range, the desired uniform haze level of less than three percent (3%) will be achieved while simultaneously attaining the benefits to downstream conveyance of the web and inhibition of the build-up of static charge during such downstream processes.

From the foregoing, it will be seen that this invention is one well adapted to attain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

What is claimed is:

1. A method for applying a liquid coating composition to a moving web comprising the steps of:

(a) continuously passing the moving web through a reservoir pan to thereby coat the moving web with the liquid coating composition contained within the reservoir pan, the reservoir pan including a discharge weir at a downstream end thereof;

(b) and simultaneously continuously delivering the liquid coating composition to the reservoir pan proximate to an upstream end thereof, the liquid coating composition being delivered in a pair of parallel end streams and a plurality of parallel intermediate streams all flowing toward the discharge weir, the parallel end streams velocity through the reservoir pan being greater than parallel intermediate streams.

2. A method as recited in claim 1 wherein:

said delivering step is performed through a distribution conduit at least partially residing within the reservoir pan, said distribution conduit having a first end and a second end with a plurality of orifices located between said first and second ends of the distribution conduit.

3. A method as recited in claim 2 further comprising the step of:

supplying the liquid coating composition through a feed conduit manifold to each of said first and second ends of said distribution conduit.

4. A method as recited in claim 2 further comprising the step of:

maintaining a level of the liquid coating composition with the weir, said orifices positioned below said level.

5. A method as recited in claim 1 wherein:

the liquid coating composition contains suspended particulates.

6. A method as recited in claim 1 further comprising the step of:

directing all of the end streams and the intermediate streams generally tangent to a curved bottom surface of the reservoir pan.

7. A method for applying a liquid coating composition containing suspended particles to a moving web, the method comprising the steps of:

(a) maintaining a level of the liquid coating composition in a reservoir pan with a discharge weir, the discharge weir being located at a downstream end of the reservoir pan;

(b) coating the moving web with the liquid coating composition by passing the moving web through the reservoir pan, the reservoir pan being open to atmosphere; and (c) simultaneously delivering additional liquid coating composition to the reservoir pan proximate an upstream end thereof, the liquid coating composition flowing through the reservoir pan in a pair of end streams and a plurality of intermediate streams, all of the end streams and intermediate streams being parallel to one another and flowing toward the discharge weir, the end streams velocity being greater than the intermediate streams velocity.

8. A method for applying a liquid coating composition containing suspended particles to a moving web, the method comprising the steps of:

(a) maintaining a level of the liquid coating composition in a reservoir pan with a discharge weir, the discharge weir being located at a downstream end of the reservoir pan;

(b) coating the moving web with the liquid coating composition by passing the moving web through the reservoir pan, the reservoir pan being open to atmosphere; and (c) maintaining the suspended particles in suspension by delivering additional liquid coating composition to the reservoir pan proximate an upstream end thereof, the liquid coating composition flowing across the reservoir pan in a pair of end streams and a plurality of intermediate streams, all of the end streams and intermediate streams being parallel to one another and flowing toward the discharge weir, the end streams velocity being greater than the intermediate streams velocity.

9. A method as recited in claim 8 further comprising the step of:

directing all of the end streams and the intermediate streams generally tangent to a curved bottom surface of the reservoir pan.

* * * * *